US007394199B2

(12) United States Patent
Axelsson et al.

(10) Patent No.: US 7,394,199 B2
(45) Date of Patent: Jul. 1, 2008

(54) HOMOGENEOUS CATHODE UNIT

(75) Inventors: Folke Axelsson, Ramdala (SE); Patrik Olsson, Ramdala (SE); Mikael Severinsson, Rödeby (SE)

(73) Assignee: Auralight Intérnational AB, Karlskrona (SE)

( * ) Notice: Subject to any disclaimer, the term of this patent is extended or adjusted under 35 U.S.C. 154(b) by 147 days.

(21) Appl. No.: 10/510,445

(22) PCT Filed: Apr. 4, 2003

(86) PCT No.: PCT/SE03/00548

§ 371 (c)(1),
(2), (4) Date: Aug. 17, 2006

(87) PCT Pub. No.: WO03/088307

PCT Pub. Date: Oct. 23, 2003

(65) Prior Publication Data

US 2006/0290283 A1 Dec. 28, 2006

(30) Foreign Application Priority Data

Apr. 11, 2002 (SE) ..... 0201096

(51) Int. Cl.
*H01J 1/02* (2006.01)
*H01J 9/00* (2006.01)

(52) U.S. Cl. ..... 313/632; 313/492; 313/613; 313/352; 313/574; 445/25; 445/26; 445/35; 445/42; 445/46; 445/55; 445/56

(58) Field of Classification Search ..... 313/491, 313/492, 574, 590, 613, 631, 632, 240, 352; 445/25, 26, 35, 42, 46, 51, 55, 56
See application file for complete search history.

(56) References Cited

U.S. PATENT DOCUMENTS

| | | | | |
|---|---|---|---|---|
| 5,043,627 | A * | 8/1991 | Fox | 313/491 |
| 5,686,795 | A | 11/1997 | Sakoske | |
| 6,097,152 | A | 8/2000 | Nieda | |
| 6,445,121 | B1 * | 9/2002 | Roes et al. | 313/492 |
| 6,630,787 | B2 * | 10/2003 | Van Der Pol et al. | 313/574 |
| 6,646,365 | B1 * | 11/2003 | Denissen et al. | 313/238 |

FOREIGN PATENT DOCUMENTS

WO WO 8101344 5/1981

OTHER PUBLICATIONS

Patent Abstracts of Japan; "Low Pressure Mercury Discharge Lamp"; vol. 011, No. 363 (E-560) Nov. 26, 1987; and JP 62 136746 Jun. 19, 1987.

* cited by examiner

*Primary Examiner*—Ashok Patel
(74) *Attorney, Agent, or Firm*—Nixon & Vanderhye P.C.

(57) ABSTRACT

Cathode unit for installation in a fluorescent tube body (3) belonging to a fluorescent tube (1), which cathode unit (5) comprises a cathode screen (15a, 15, 15'-15"") which partially surrounds an electrode (9) which is electrically insulated from the said cathode screen (15), a power supply device (11) arranged to make an electrical connection between the said electrode (9) and a contact (13), the said cathode screen (15a, 15 , 15'-15"") comprising a first end (19) facing towards the discharge, which first end (19) comprises a central opening (21), and a second end (39) facing towards the said contact (13). The first end (19) of the cathode screen (15a, 15, 15'-15"") is designed with a rounded-off part (25) in order to facilitate the insertion of the cathode unit (5) in the said fluorescent tube body (3).

11 Claims, 4 Drawing Sheets

Known Technology

HOMOGENEOUS CATHODE UNIT

This application is a U.S national phase of international application PCT/SE03/00548 filed on 4 Apr. 2003, which designated the U.S. PCT/SE03/00548 claims priority to SE Application No. 0201096-5 filed 11 Apr. 2002. The entire contents of these applications are incorporated herein by reference.

BACKGROUND ART

The present invention relates to a cathode unit for fluorescent tubes according to the preamble to claim 1. The invention also relates to the manufacturing industry for fluorescent tubes and to a method for manufacturing fluorescent tubes according to the preamble to claim 10. Similarly, the present invention relates to a fluorescent tube according to the preamble to claim 11, which fluorescent tube is designed for a long life.

Today, fluorescent tubes are manufactured with a long life as regards the operating time. WO 81/01244 describes a cathode unit comprising a cathode screen, also called an electrode screen, constructed as a cylindrical casing, which casing is connected to the end facing the discharge by means of a plate of electrically insulating material provided with a central hole. The design works very satisfactorily. However, further developments of the same have resulted in improvements, particularly regarding the adaptation of the cathode unit to narrow fluorescent tubes. It has been found that the plate does not necessarily need to be made of mica or other material that does not conduct electricity.

Fluorescent tubes of the abovementioned type comprise electrodes, which alternately work as cathodes and anodes, the cathode function constituting the critical factor, both as regards length of life calculated in operating hours, and product reliability. The electrode is provided with a special emitter material, which has an ability to emit electrons at a moderate temperature and energy supply. The emitter material comprises alkali oxides. The life of the electrode is limited by evaporation and sputtering of emitter material from the electrode's so-called hot spot. The hot spot obtains its heat initially from electrical heating and kinetic energy in the incident positive ions. The emission of electrons takes place from this spot. This means that the greatest concentration of ionised emitter material, such as barium, strontium and calcium, is found in the immediate vicinity and a few millimetres out from the hot spot. The task of the cathode screen is to increase the concentration of positive ions and in particular the ionised emitter material in the immediate vicinity of the electrode's hot spot.

A problem with known technology is that installation of the cathode unit according to the known embodiment in a narrow fluorescent tube body demands great precision. Similarly, the manufacture of a cathode unit consisting of several parts requires a large amount of work, which is costly.

There are currently no cathode units suitable for narrow fluorescent tubes which prolong the operating time of the fluorescent tube, while at the same time simplifying the manufacturing process. In addition, known cathode units can not be handled in mechanical manufacturing processes.

An object of the present invention is to avoid the said disadvantages of the known technology.

An additional object of the invention is to achieve a cathode unit that remains in working order, as far as the operation of the fluorescent tube is concerned, during the transportation of the fluorescent tube.

The abovementioned problems have been solved by means of the cathode unit described in the introduction, as described in the characterising part of Claim 1.

In this way it is possible to install the cathode unit in a narrow fluorescent tube more rapidly and in a more automated way, which is cost-effective. At the same time, the risk of damage to the coating on the inside of the fluorescent tube body during the manufacture of the fluorescent tube is reduced.

Alternatively, the cathode screen is designed with at least one side wall essentially incident to a centre line. By this means, the so-called pumping process for eliminating impurities in a fluorescent tube during manufacture can be made more efficient. Similarly, the installation of the cathode unit in the fluorescent tube body is made easier, while the tolerance is greater within the area of the incident side wall.

The cathode screen is preferably manufactured in one piece. The manufacture of the cathode screen can thereby be achieved in one stage which is cost-effective. Similarly, the cathode screen is made from only one component which eliminates the risk of malfunction caused by incorrect installation of components forming the cathode screen. The smaller the components, the more difficult it is to assemble these. The cathode screen manufactured in one piece prolongs the life of the fluorescent tube by eliminating the abovementioned malfunctions.

The cathode screen is suitably manufactured of metal which has a small tendency to react with the components of the atmosphere within the fluorescent tube. Such a metal is iron. In this way, the manufacture of a cathode screen can be made more cost-effective, as the metal is simple to shape and retains its shape after processing. The use of the pure metal, such as preferably pure iron, means that there are no chemical impurities which, if present, could cause reduced function of the cathode's emitter material. It has been shown by experiment that a cathode screen that is manufactured completely of pure metal, in which the central opening is approximately 5 mm in diameter, has the ability to collect and retain a large number of positive charged particles for a considerable time in the vicinity of the hot spot, which contributes to the return of the emitter material to the electrode.

Alternatively, the cathode screen is designed with at least one slot within the area of the said power supply device. The cathode screen can thereby be electrically insulated from the electrode even if, during transportation, the cathode screen comes to rest in a position that is displaced in relation to the centre line of the fluorescent tube. Similarly, the distance can be increased between the two power supply devices while retaining the insulation reliability. In addition, longer cathode spirals with more emitter material can be used, which prolongs the operating time of the fluorescent tube.

The cathode screen is preferably provided on the outside with a heat-insulating material. In this way, it is ensured towards the end of the life of the electrode that the cathode screen does not conduct heat to the wall of the fluorescent tube when the cathode screen is heated up by the electrode resulting in it being bent downwards by the force of gravity towards the wall of the fluorescent tube as a result of heating and softening of the device holding the cathode screen. The danger is thereby avoided of the fluorescent tube shattering and falling out of its mounting.

The outer side of the cathode screen viewed in the longitudinal direction of the cathode screen, suitably follows a straight line essentially parallel to the longitudinal axis of the said fluorescent tube body. A maximal amount of emitter material can thereby be applied to an electrode, whereby the life of the fluorescent tube is prolonged. This is to say, a cathode screen arranged centrally to the centre line of the fluorescent tube body and where the wall thickness of the cathode screen is even, means that both the input points of an electrode can be located at a maximal distance from each other inside the wall of the cathode screen. The cathode screen is placed at such a distance from the wall of the fluorescent tube body that there is no contact between them. The distance between the electrode and the inner side of the cathode screen is to be as small as possible in order for the desired effect to be obtained. However there must be no electrical contact between them.

Any occurrence of polluted gases in the discharge also has a de-ionising effect. The use of a cathode screen makes high demands on the design of the cathode unit, as the ignition of the fluorescent tube can be carried out more easily without the use of any cathode screen. This makes high demands on an elimination of the gaseous impurities in the fluorescent tube.

Alternatively, the second end of the cathode screen is completely open. During the manufacture of the fluorescent tube, various types of pump processes are used to remove the decomposition products of the emitter material. Effective pumping is particularly important for cathode units with the maximal amount of emitter material. The completely open second end ensures that satisfactory ventilation is achieved by the pump process for the removal of the decomposition products and other impurities. The life of the fluorescent tube is thereby prolonged. The completely open second end is also achieved in order to reduce the weight of the cathode screen, which reduces the risk of the cathode screen being displaced in a radial direction during transportation. The lower the weight, the less turning moment with the device holding the cathode screen acting as a lever, and the cathode screen can be held in position during the transportation. Similarly, the completely open second end allows the electrode to be inserted into the cathode screen in a simple way during the manufacture of the cathode unit.

The inner side of the cathode screen is preferably coated with an electrically-insulating material. The cathode screen can thereby be electrically insulated from the electrode even if, during transportation, the cathode screen comes to rest in a position that is displaced in relation to the centre line of the fluorescent tube body.

The abovementioned problems have been solved by means of the method described in the introduction, by the steps described in the characterising part of the claim 10.

In this way, the manufacture of the fluorescent tube is made more efficient. As the cathode screen is manufactured in one piece, time can be saved during the production, which is cost-effective. For the large amount of emitter material achieved according to the present invention, in relation to the relatively small space inside the cathode screen, the completely open opening at the second end of the cathode screen means that an efficient removal of the decomposition products can be carried out by the pumping process.

The abovementioned problems have similarly been solved by means of the fluorescent tube described in the introduction, as described in the characterising part of the claim 11. In this way, a narrow fluorescent tube has been achieved, for example the so-called T5, T4 and T3 fluorescent tube, which is simple to manufacture and which has a longer life in relation to known technology. The same technology can also be used for the T8 fluorescent tube.

BRIEF DESCRIPTION OF DRAWINGS

In the following, the invention will be described with reference to the drawings, in which.

MODES FOR CARRYING OUT THE INVENTION

The invention will now be described in the form of embodiments. For the sake of clarity, components not of relevance to the invention have been omitted from the drawings. In certain cases, the same components that are shown on several drawings are not given a reference number, but correspond to those that have been given a reference number.

Figure 1A:
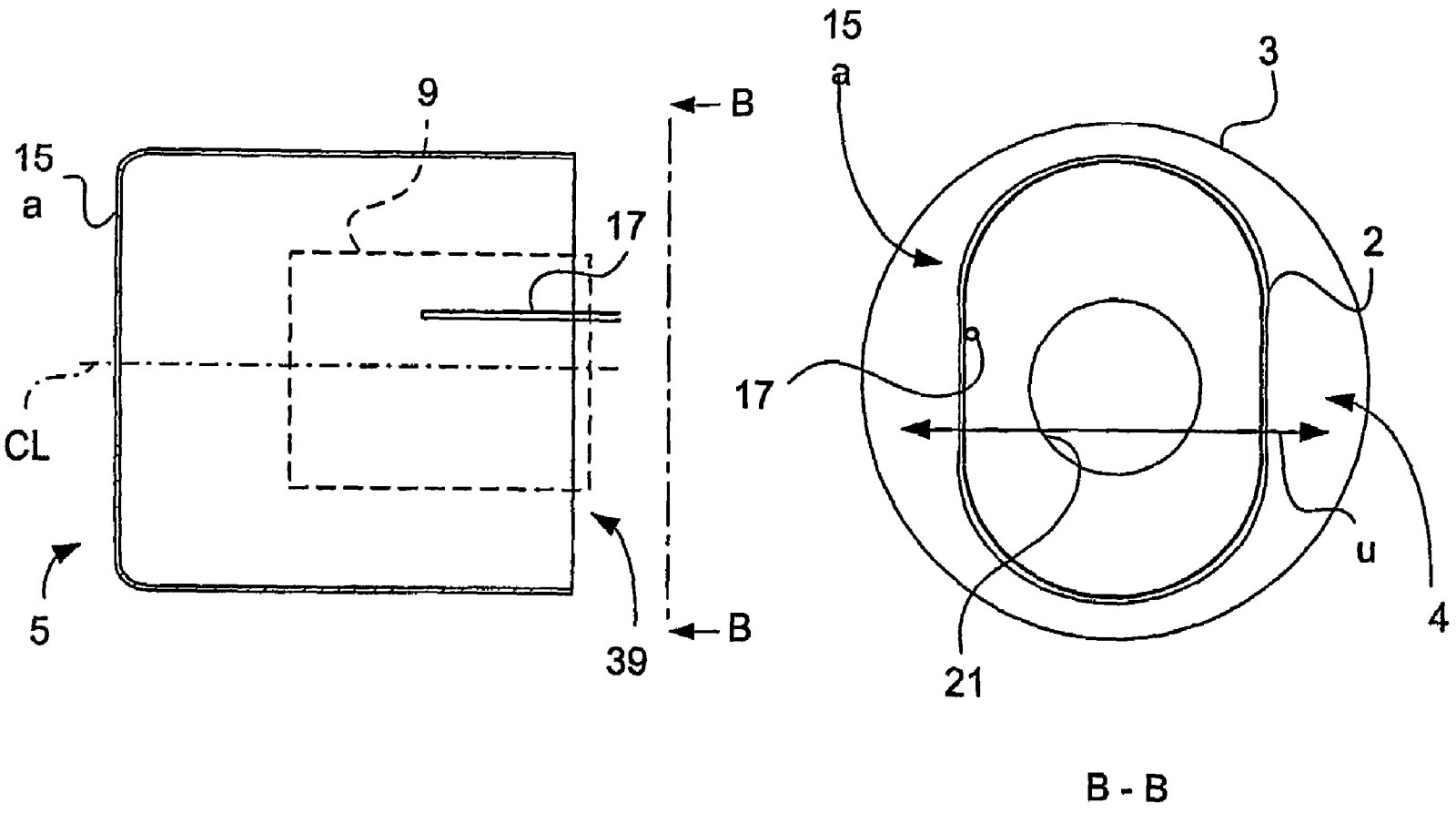
FIG. 1*a* shows schematically a cathode unit according to a first embodiment.

FIG. 1*a* shows a cathode screen 15*a* for a cathode unit 5 according to a first embodiment. To the left is shown the cathode screen 15*a* in cross-section from the side and to the right is shown the cathode screen 15*a* incorporated in a fluorescent tube body 3. In order to make more efficient a so-called pumping process for the elimination of impurities in a fluorescent tube 1 during manufacture, which will be described in greater detail below, the cathode screen 15*a* has been designed with two side walls 2 becoming incident to the centre line CL. A space 4 created between the cathode screen 15*a* and the fluorescent tube body 3 in combination with a completely open second end 39 of the cathode screen 15*a* means that the through-flow is very effective for the removal of the said impurities. The assembly of the cathode screen 15*a* to a fixing device 17 is simplified by the flat surface that is obtained. Similarly, insertion of the cathode unit 5 in the fluorescent tube body 3 of the fluorescent tube 1 during the manufacture of the fluorescent tube 1 is made simpler. A greater tolerance is obtained in the direction u-u, which contributes to more reliable insertion during assembly, without the cathode screen 15*a* coming into contact with the fluorescent tube body 3.

Figure 1B:
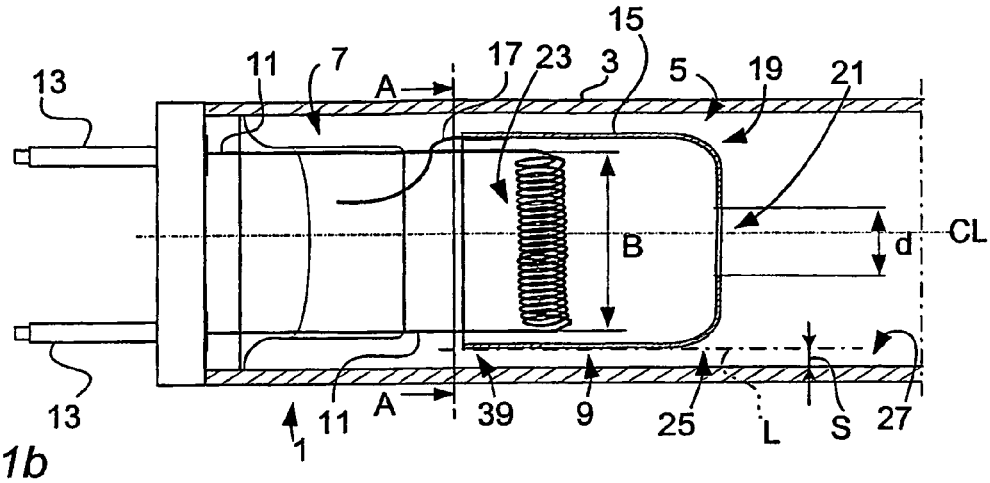
FIG. 1*b* shows schematically a cathode unit according to a second embodiment.

FIG. 1*b* shows a longitudinal section of one end of the fluorescent tube body of the fluorescent tube 1 comprising the cathode unit 5 according to a second embodiment. The fluorescent tube body 3, such as a glass bulb, of the fluorescent tube 1 is connected at its respective end in a conventional way by a foot 7 which also serves as a means of support for a power supply device 11 supporting an electrode 9. The power supply device 11 is arranged to make an electrical connection between the electrode 9 and a contact 13 arranged at one end of the fluorescent tube 1, which contact can be connected to a power supply unit (not shown). The electrode 9 is partially surrounded by the cathode screen 15. The cathode screen 15 is supported by a fixing device 17, such as a metal strut, and is electrically insulated from the electrode 9 by means of the electrically-insulating foot 7. A first end 19 of the cathode screen 15 comprises a central opening 21. The first end 19 faces towards the discharge, that is to say towards the other end of the fluorescent tube 1 and the electrode (not shown) arranged there. The central opening 21 has a diameter d of 3-8 mm, preferably 5-7 mm, which has been shown by experiment to be the most efficient size of the central opening 21 in cathode screens 15 for narrow fluorescent tubes, such as fluorescent tubes with a diameter of 16 mm.

The first end 19 is shaped with a rounded-off part 25 to make easier the insertion of the cathode unit 5 into the fluorescent tube body 3 during manufacture. The fluorescent tube body 3 of the fluorescent tube 1 is coated on the inside with a phosphor powder 27. The rounded-off part 25 means that the cathode unit 5 can be assembled in the fluorescent tube body 3 in a reliable way without the coating, such as the phosphor powder 27, being scraped off the inside of the fluorescent tube body 3.

Figure 1C:
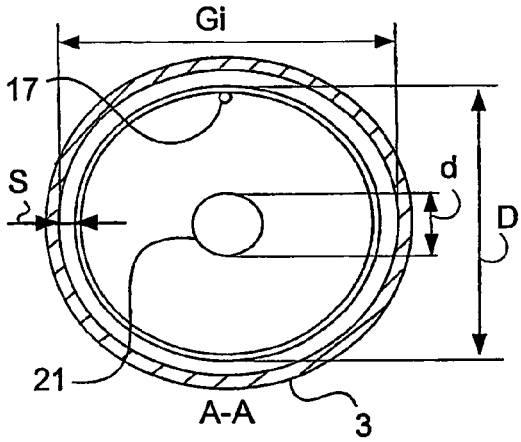
FIG. 1*c* shows schematically a cross section of a cathode screen in FIG. 1*b*.

FIG. 1*c* shows a cross section A-A of the cathode unit 5 shown in FIG. 1*b*. In order that the maximal amount of emitter material 23 can be applied on the electrode 9 to give a long operating time, the cathode screen 15 is manufactured with a thin material thickness in order to create as large a space as possible inside the cathode screen 15. The outer side of the cathode screen 15, viewed in the longitudinal direction of the cathode screen 15, follows a straight line L parallel to the longitudinal axis of the fluorescent tube body 3 and a centre line CL. The outer side or the external diameter D of the cathode screen 15 is smaller than the internal diameter Gi of the fluorescent tube body 3, so that a gap S is created of 1-4 mm in size, preferably 2-3 mm. In this way, the maximal amount of emitter material 23 can be applied on the electrode 9 along the section B between the fixing points 29 of the electrode 9.

The cathode screen 15 is manufactured in one piece, which means that the cathode screen 15 can be produced in a single stage. The cathode screen 15 is formed in this embodiment by pressing the metal, such as iron or nickel, in a pressing tool (not shown). Although the cathode screen 15 has relatively small dimensions, the manufacturing process means that small components do not need to be assembled together. This has great advantages. Manufacturing the cathode screen 15 in one piece is cost-effective and improves the operating characteristics of the cathode screen 15 which prolongs the life of the fluorescent tube 1. Many small components assembled together to form a unit can increase the danger of malfunction. In particular, when manufacturing narrow fluorescent tubes, where cathode screens are constructed of small components with a relatively small dimension, the danger of malfunction is relatively great on account of these small components. The present cathode screen 15 eliminates such malfunctions.

Figure 1D:
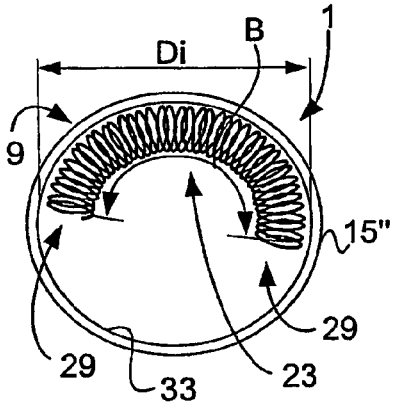
FIG. 1*d* shows schematically the layout of an electrode according to a third embodiment.
Figure 1E:
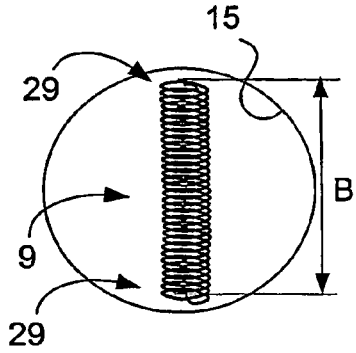
FIG. 1*e* shows schematically the layout of the electrode shown in FIG. 1*b*.

FIG. 1*d* shows schematically the layout of an electrode 9 and its arrangement in relation to a cathode screen 15" according to a third embodiment. The emitter material 23 is applied along the section B between the fixing points 29 of the electrode 9. The fixing points 29 are arranged simply adjacent to the inner side 33 of the cylinder-shaped cathode screen 15", as the cathode screen 15" does not have a bottom. In this way, a large quantity of emitter material 23 can be fitted on the electrode 9 surrounded by the cathode screen 15". The cathode unit 5 shown in FIG. 1*b* is shown in FIG. 1*e*, where the electrode 9 has a straight section between the fixing points 29.

Figure 2A:
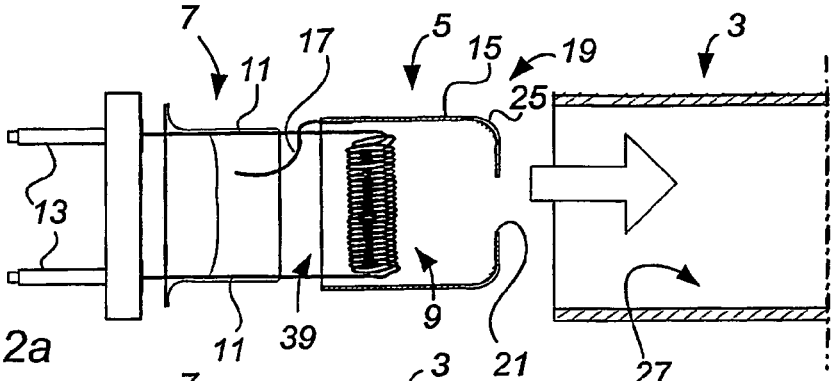
FIG. 2*a* shows schematically the commencement of the insertion of the cathode unit in FIG. 1*b* in a fluorescent tube body.
Figure 2B:
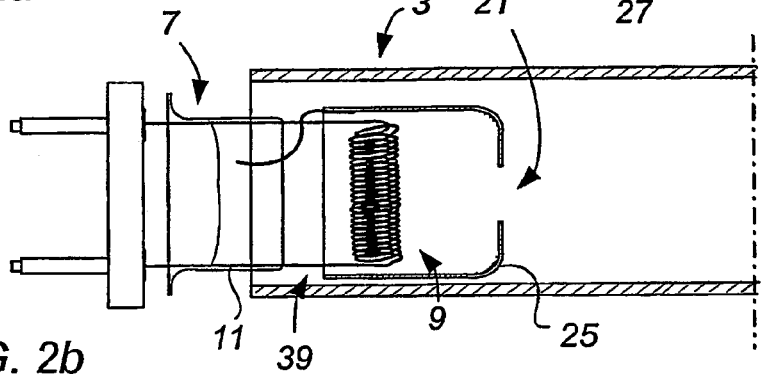
FIG. 2*b* shows schematically the completion of the insertion.

FIGS. 2*a* and 2*b* show the insertion of the cathode unit 5 in FIG. 1*a* into a fluorescent tube body 3 with phosphor powder 27 applied on the inside of the fluorescent tube body 3. The rounded-off part 25 of the cathode screen 15 means that the insertion of the cathode unit 5 is simplified, while at the same time the phosphor powder 27 is not damaged. In this way, the phosphor powder 27 remains intact and the manufacture of the fluorescent tube 1 is cost-effective.

Figure 3A:
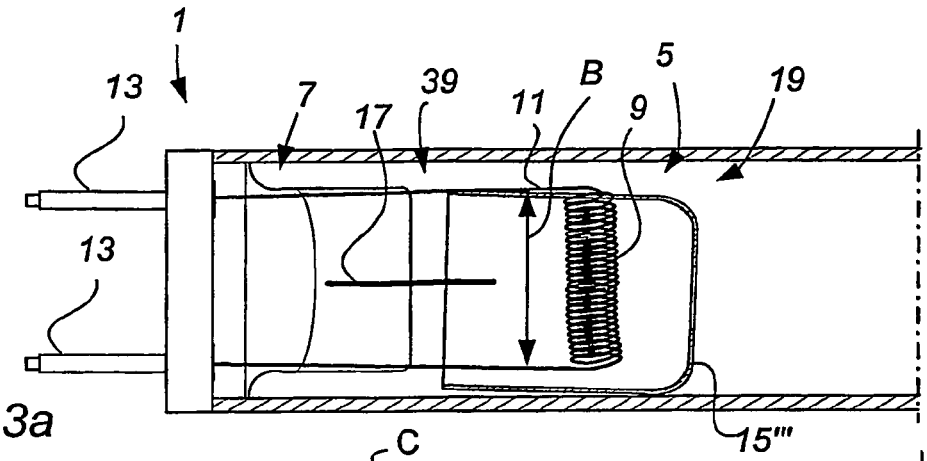
FIG. 3*a* shows schematically a cathode screen in side view according to a fourth embodiment.
Figure 3B:
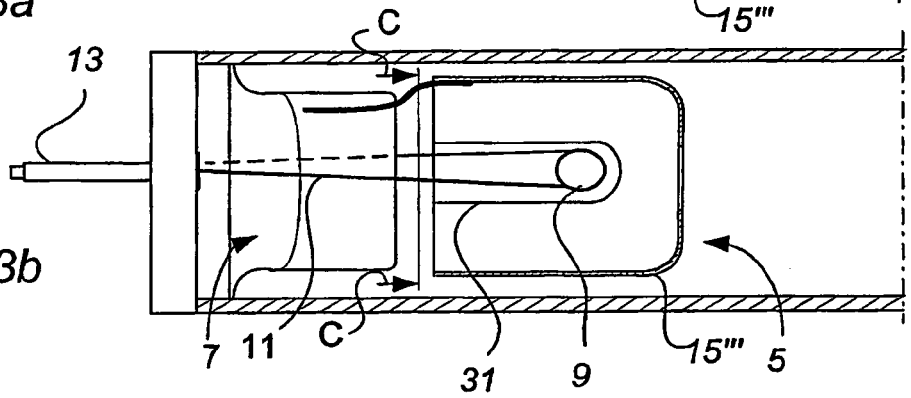
FIG. 3*b* shows schematically the cathode screen in FIG. 3*a* in side view.
Figure 3C:
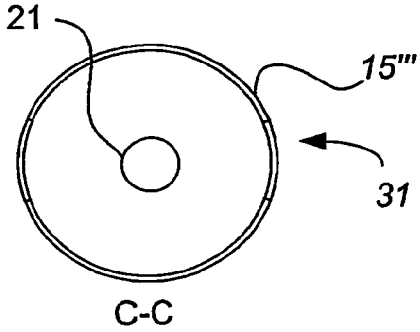
FIG. 3*c* shows schematically a cathode screen in FIG. 3*b* in cross-section C-C.

FIGS. 3*a*-3*c* show a cathode screen 15'" according to a fourth embodiment. FIG. 3*b* shows the cathode screen 15'" in side view and FIG. 3*c* shows the cathode screen 15'" in FIG. 3*b* in a view C-C. The reference numbers correspond to those shown in the previous figures. According to this embodiment, the cathode screen 15'" is designed with two slots 31 within the area of the power supply device 11. It has been shown by experiment, that the slot 31 does not significantly affect the escape of emitter material 23 from the interior of the cathode screen 15'". The fixing points 29 can be positioned slightly out in the respective slot 31, whereby additional emitter material 23 can be applied on the electrode 9. In this way, a prolonged life of the fluorescent tube 1 is achieved.

During transportation of the fluorescent tube 1 this is subjected to unforeseen forces. If the cathode screen 15'" is displaced from its position somewhat and is bent downwards, which is shown in exaggerated form in FIG. 3*a* in order to clarify the situation, the electrode 9 does not come into contact with the cathode screen 15'" but reaches a position within the area of the slot 31, and thus remains electrically insulated from the electrode 9. This means that the operational reliability of the fluorescent tube 1 is increased. In this way, the electrode 9 can be made longer without the risk of shorting and can thereby also be given additional emitter material 23, whereby the life of the fluorescent tube is increased.

Figure 3D:
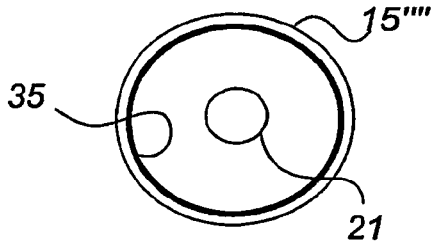
FIG. 3*d* shows schematically a cathode screen according to a fifth embodiment.

FIG. 3*d* shows a cathode screen 15"" according to a fifth embodiment, in which an electrically insulating material 35, such as porcelain or enamel, is coated on the inner side 33 of the cathode screen 15"". In this way, in the event of it coming into contact with the cathode screen 15"", the electrode 9 is still electrically insulated from this.

Figure 4A:
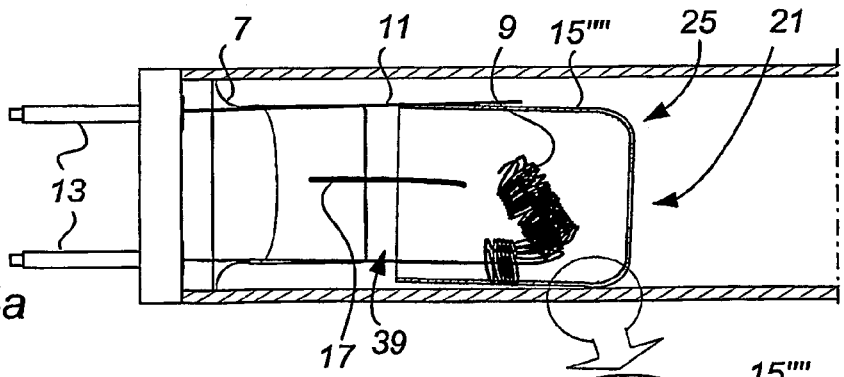
FIGS. 4*a* and 4*b* show schematically the cathode screen in FIG. 3*a*.

At the end of the life of the electrode 9, when the emitter material 23 has been used up, the cathode screen 15"" is heated up by the strongly heated-up electrode 9, whereby the fixing device 17 may be softened whereupon the cathode screen 15"" is bent down towards the fluorescent tube body 3 by the force of gravity. FIG. 4*a* shows schematically how the electrode 9 has burnt off and in this way heated up the cathode screen 15"".

Figure 4C:
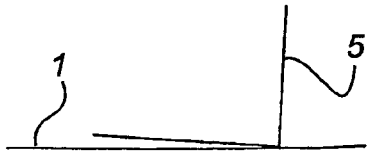
FIG. 4*c* shows schematically a part of a cathode screen according to known technology.
Figure 4B:
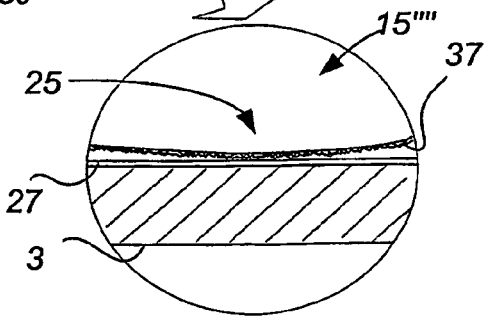

FIG. 4*b* shows an enlarged section of the contact point between the fluorescent tube body 3 and the cathode screen 15"". A heat-insulating material 37 is applied to the cathode screen 15"", which material can be glass, and prevents to a great extent the transmission of heat from the heated-up cathode screen 15"" to the fluorescent tube body 3, whereby the danger of the fluorescent tube 1 shattering and falling out of its mounting (not shown) is eliminated. The rounded-off part 25 of the cathode screen 15"" increases the contact surface between the cathode screen 15"" and the fluorescent tube body 3, which means that the heat is distributed over a large area. FIG. 4*c* shows a cathode screen according to known technology, where a sharp corner exudes heat over a very small area, which results in a great danger of the fluorescent tube shattering.

Impurities in the fluorescent tube often consist of the normal components of air, for example oxygen, nitrogen, carbon dioxide, impurities of the hydrocarbon type and decomposition products from the emitter material, for example carbon dioxide. Impurities within the fluorescent tube 1 can impair the function and life of the fluorescent tube 1. Therefore various types of pumping processes are used to remove different gases, for example to remove decomposition products from the emitter material 23. Impurities, which principally occur in molecular form, have the ability to absorb energy from processes in the discharge which have the function of ensuring an effective ionisation of the emitter material 23. Any impurities thereby also result in a deterioration in the return of emitter material 23 to the electrode 9. Certain end products from the impurities have a similar negative effect on the emission capabilities of the cathode unit 5.

A method for pumping, gas filling and sealing of a fluorescent tube 1 is carried out by the fluorescent tube 1 being provided with a pumping pipe (not shown) at each end. A vacuum is created at one end, while a lamp-filling gas is supplied at the other end, which gas "flushes out" the said decomposition products from the emitter material 23.

The emitter material 23 on the electrode 9 comprises carbonates that must not remain in the fluorescent tube 1 when this is sealed. Approximately a third of the weight of the emitter material 23 is converted to gas and removed in an efficient way. One way of achieving an effective pumping process is so-called "argon rinsing" in which argon is applied in the fluorescent tube 1 repeatedly. By passing a current through the electrode 9 during the process, the emitter material 23 is heated up to 1000-1200 degrees Celsius, which means that the material is decomposed so that carbon dioxide and carbon monoxide are removed, while the alkali oxides remain in the emitter material 23.

Another way is vacuum pumping at a high temperature in combination with "internal pumping" achieved by mercury drops being fed into the hot fluorescent tube 1, with the process being repeated a number of times. When the mercury drops meet the fluorescent tube 1, they are quickly vaporised and give rise to a diffusion pump effect in the fluorescent tube 1, whereby removal of the impurities takes place. It has been shown by experiment that the most effective removal is achieved when the cathode screen 15 has a completely open second end 39. It has also been found that the completely open second end 39 has a very small effect upon the plasma density adjacent to the "hot spot" of the electrode 9, which is advantageous with regard to the life of the electrode 9.

As the second end 39 of the cathode screen 15 is completely open, this means that an effective pumping process and removal from the fluorescent tube 1 of the said decomposition products produced from the maximal achieved amount of emitter material 23 between the fixing points 29 is carried out in a more effective way than was previously the case.

Figure 5:
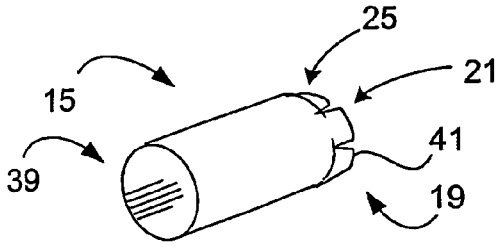
FIG. 5 shows schematically a cathode screen according to a sixth embodiment.

The completely open second end 39 also means that the manufacturing process is simplified. For example, the cathode unit 5 can be manufactured from a cylinder blank made from a metal strip, which blank is cut off into suitable lengths. The first end 19 of each cathode screen 15 that is produced is bent so that a rounded-off section 25 is provided, drawing the end together with a central opening 21. The first end 19 can also comprise flaps 41 that are bent to draw the end together. Such a cathode screen 15 according to a sixth embodiment is shown in FIG. 5.

A large amount of emitter material 23 on the electrode 9 has a positive effect on the life of the fluorescent tube 1. It is desirable that the degree of ionisation attains the highest possible value, within the whole of the area where there is a high occurrence of emitter material. The design of the present cathode unit 5 means that a maximal amount of emitter material 23 can be applied on the electrode 9 and that vaporised and sputtered emitter material can be ionised to a high degree.

By achieving the distance between the fixing points 29 of the electrode 9 and arranging the electrode 9 in such a way that as much emitter material 23 as possible can be accommodated, while at the same time the electrode 9 is arranged at such a distance from the inner side 33 of the cathode screen 15 that this is electrically insulated from the cathode screen 15, a fluorescent tube 1 is achieved with a longer life than with known technology. The cathode screen 15 itself is arranged at the least possible distance from the wall of the fluorescent tube body 1.

As the inner and outer side of the cathode screen 15 extend in the longitudinal direction of the fluorescent tube 1 along a straight line L, which sides are parallel with the longitudinal axis of the fluorescent tube 1 and the centre line CL, the fixing points 29 can be arranged at a maximal distance from each other. In this way, as much emitter material 23 as possible can be accommodated between the fixing points 29.

Figure 6:
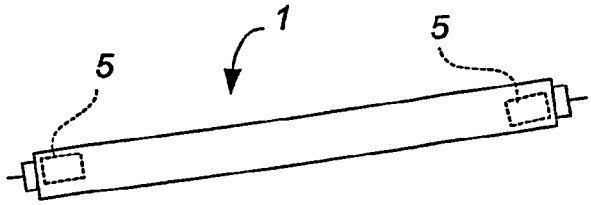
FIG. 6 shows schematically a fluorescent tube comprising cathode units according to the invention.

A fluorescent tube 1, as shown in FIG. 6, is manufactured according to a method that is characterised by the stages: pressing the said cathode screen 15 in one piece, with the first end 19 being shaped with a rounded-off part 25; welding the cathode screen 15 to the fixing device 17 that is attached to the foot 7; assembling the said cathode screen 15 to the said foot 7; inserting the said cathode unit 5 in the said fluorescent tube body 3; removal of decomposition products of the emitter material 23 by pumping; and sealing the fluorescent tube 1 when all the decomposition products have been removed from the fluorescent tube 1.

The embodiments and similar variants are of course within the framework of the present invention. The cathode screen 15 can be manufactured from materials other than metal, for example a material that does not conduct electricity, coated for example by enamel or glass. Alternatively, the cathode screen can be manufactured completely of glass.

The fixing device 17 can similarly be constructed to be heat resistant in order to avoid the abovementioned bending downwards of the cathode screen 15. Of course, the central opening 21 can also be a different shape, for example elliptical or angular. The cathode screen 15 itself can also have an angular or tapering cross section.

The invention claimed is:

1. Cathode unit for installation in a fluorescent tube body (3) belonging to a fluorescent tube (1), which cathode unit (5) comprises a cathode screen (15*a*, 15, 15'-15''''), which partially surrounds an electrode (9) which is electrically insulated from the said cathode screen (15), a power supply device (11) arranged to make an electrical connection between the said electrode (9) and a contact (13), the said cathode screen (15) comprising a first end (19) facing towards the discharge, which first end (19) comprises a central opening (21), and a second end (39) facing towards the said contact (13), characterised in that the first end (19) of the cathode screen (15*a*, 15, 15'-15'''') is designed with a rounded-off part (25) in order to facilitate the insertion of the cathode unit (5) in the said fluorescent tube body (3).

2. Cathode unit according to claim 1, characterised in that the said cathode screen (15*a*) is designed with at least one side wall (2) essentially incident to a centre line (CL).

3. Cathode unit according to claim 1, characterised in that the said cathode screen (15*a*, 15, 15'-15'''') is manufactured in one piece.

4. Cathode unit according to claim 1, characterised in that the said cathode screen (15*a*, 15, 15'-15"") is manufactured of metal.

5. Cathode unit according to claim 1, characterised in that the said cathode screen (15*a*, 15, 15'-15"") is designed with at least one slot (31) within the area for the said power supply device (11).

6. Cathode unit according to claim 1, characterised in that the said cathode screen (15*a*, 15, 15'-15"") is provided on the outside with a heat-insulating material (37).

7. Cathode unit according to claim 1, characterised in that the outer side of the said cathode screen (15*a*, 15,15'-15""), viewed in the longitudinal direction of the cathode screen (15), follows a straight line L essentially parallel to the longitudinal axis of the said fluorescent tube body.

8. Cathode unit according to claim 1, characterised in that the second end (39) of the said cathode screen (15*a*, 15, 15'-15"") is completely open.

9. Cathode unit according to claim 1, characterised in that the inner side (33) of the said cathode screen (15*a*, 15, 15'-15"") is coated with an electrically-insulating material.

10. Method for manufacturing a fluorescent tube (1) comprising a fluorescent tube body (3), a cathode unit (5), which cathode unit (5) comprises a cathode screen (15*a*, 15, 15'-15"") which partially surrounds an electrode (9) provided with emitter material (23), which electrode (9) is electrically insulated from the said cathode screen (15), a power supply device (11) attached to a foot (7), which power supply device (11) is arranged to make an electrical connection between the said electrode (9) and a contact (13), the said cathode screen (15) comprising a first end (19) facing towards the discharge, which first end comprises a central opening (21), and a second end (39) facing towards the said contact (13), characterised by the stages:

pressing the said cathode screen in one piece with the first end (19) being shaped with a rounded-off part (25);

welding the cathode screen (15*a*, 15, 15'-15"") to a fixing device (17) that is attached to the said foot (7);

inserting the said cathode unit (5) in the said fluorescent tube body (3); removal of decomposition products of the emitter material (23) by pumping; and sealing the fluorescent tube (1) when all the decomposition products have been removed from the fluorescent tube (1).

11. Fluorescent tube comprising at least one cathode unit (5) according to claim 1.

* * * * *